US009782663B2

(12) United States Patent
Bjertnaes et al.

(10) Patent No.: US 9,782,663 B2
(45) Date of Patent: Oct. 10, 2017

(54) MECHANISM FOR LOCKING LONGITUDINALLY A SKI-BINDING ON A MOUNTING PLATE

(71) Applicant: Madshus AS, Biri (NO)

(72) Inventors: Gunnar Bjertnaes, Biri (NO); Bjorn Ivar Austrem, Biri (NO)

(73) Assignee: MADSHUS AS, Biri (NO)

( * ) Notice: Subject to any disclaimer, the term of this patent is extended or adjusted under 35 U.S.C. 154(b) by 0 days.

(21) Appl. No.: 15/126,872

(22) PCT Filed: Mar. 19, 2015

(86) PCT No.: PCT/EP2015/055814
§ 371 (c)(1),
(2) Date: Sep. 16, 2016

(87) PCT Pub. No.: WO2015/140258
PCT Pub. Date: Sep. 24, 2015

(65) Prior Publication Data

US 2017/0106268 A1 Apr. 20, 2017

(30) Foreign Application Priority Data

Mar. 19, 2014 (EP) ..... 14160763

(51) Int. Cl.
*A63C 9/20* (2012.01)
*A63C 9/00* (2012.01)

(52) U.S. Cl.
CPC ..... *A63C 9/005* (2013.01); *A63C 9/20* (2013.01); *A63C 2009/008* (2013.01)

(58) Field of Classification Search
CPC .. A63C 9/005; A63C 9/20; A63C 9/22; A63C 2009/008
(Continued)

(56) References Cited

U.S. PATENT DOCUMENTS 7,393,002 B2 * 7/2008 Thomas ..... A63C 9/005 280/613
7,744,113 B2 * 6/2010 Farges ..... A63C 9/005 280/11.31
(Continued)

FOREIGN PATENT DOCUMENTS

DE 1929885 A1 12/1970
EP 1 748 827 A1 2/2007
(Continued)

OTHER PUBLICATIONS

International Search Report and Written Opinion for International Application No. PCT/EP2015/055814, dated May 4, 2015, 9 pages.

*Primary Examiner* — John Walters
(74) *Attorney, Agent, or Firm* — Westman, Champlin & Koehler, P.A.

(57) ABSTRACT

Provided is a locking mechanism for a ski-binding, the locking mechanism comprising only one lever adapted to be pivoted between an engaged and a disengaged position. The lever further comprises at least one lug, the at least one lug adapted to engage with a notch formed in a mounting plate in an engaged position, and wherein the lug is adapted to hold the lever in a non-sliding manner when engaged with the notch. Explicitly, the locking mechanism does not comprise a second lever. Also provided is a ski-binding comprising only one locking mechanism, or adapted to receiving only one locking mechanism, and a mounting plate for use with the locking mechanism, and ski-binding.

34 Claims, 12 Drawing Sheets

(58) Field of Classification Search
USPC ..... 280/613, 616, 617, 618
See application file for complete search history.

(56) References Cited

U.S. PATENT DOCUMENTS

| | | | | |
|---|---|---|---|---|
| 7,828,303 | B2 * | 11/2010 | Girard | A63C 5/07 280/11.3 |
| 8,585,074 | B2 * | 11/2013 | Vailli | A63C 9/003 280/611 |
| 2013/0241179 | A1 * | 9/2013 | Wollo | A63C 9/003 280/611 |

FOREIGN PATENT DOCUMENTS

| | | | |
|---|---|---|---|
| EP | 2 090 338 | A1 | 8/2009 |
| WO | 88/04563 | A1 | 6/1988 |
| WO | 2005/113081 | A1 | 12/2005 |

* cited by examiner

MECHANISM FOR LOCKING LONGITUDINALLY A SKI-BINDING ON A MOUNTING PLATE

The present invention relates to a locking mechanism for use with a ski-binding, in addition to a ski-binding including or adapted to receive the locking mechanism. Further, the present invention provides a mounting plate suitable for engaging with the locking mechanism of the present invention.

Ski-bindings are generally used to attach a ski boot in a secure and safe manner to a ski. In the general art, a mounting plate is provided on the top surface of the ski and a ski binding is subsequently positioned relative to the mounting plate and attached at a desired position. Once attached, the ski-binding is locked onto the plate.

Conventional skis often employ a ski-binding in a relatively fixed orientation to the ski and mounting plate. To adjust the location of the binding, one must often use a special tool to loosen the locking mechanism and slide the binding to the desired position, before fixing the binding using the same tool. For conventional skis, the position of the ski-binding is often not required to be changed, particularly for skiers of a beginner or amateur ability.

However, for advanced skiers, and more specifically, for cross country skiers/skis, the position of the binding relative to the ski is of crucial importance. Indeed, different snow conditions can require different positions of the ski-binding for the skier to be able to obtain maximum performance from the ski.

Snow conditions can be affected by all manner of environmental conditions. For example, the snow condition can change with differing temperatures, the age of the snow, the relative atmospheric pressure, the current weather condition, and many other factors.

For a skier to obtain the maximum performance from the ski, the weight distribution of the skier must be optimal. Moreover, the skier also develops a certain "feel" of the snow through the ski. To achieved the best "feel" and inherently increase the skiers confidence, the position of the ski-binding must be changed depending upon the conditions.

In cross-country skiing in particular, the snow conditions can vary over the length of the run or course. In some cases, the snow conditions can vary substantially, meaning that it is beneficial for the skier to stop and adjust the position of the ski-binding despite losing time by doing so. In other words, the skier may travel faster and/or with more control by adjusting the position of the ski-binding mid-run.

Of course, stopping to adjust the ski-binding means that the skier loses time and it is desirable to minimise the time that the skier spends adjusting the position of the ski-binding.

EP 1 748 827 B1 discloses a system for adjusting and locking the position of a ski-binding relative to a mounting plate. In this document, a latching device includes two, oppositely facing latch units that are adapted to interact with notches provided on the mounting plate. Each latch unit is provided with locking teeth that have a certain profile, typically one that is similar or matches the profile of the notches.

The notches and locking teeth are arranged in an oppositely facing manner. In this sense, the profile of the locking teeth and notches is approximately in the shape of a right angled triangle. The forward or front latch unit is provided with the teeth orientated such that the right angle of the right angled triangle faces a first direction, typically the forward direction, and the rearward or rear latch unit is provided with the teeth orientated such that the right angle of the right angled triangle faces a second direction, typically the rearward direction. Accordingly, the notches are provided with the corresponding profile.

In operation, a skier may actuate the front or rear latch unit from a locked position, which is an at rest position, to an unlocked position by applying an upward force to an edge of the latch unit. Accordingly, once one of the latch units is unlocked, the binding may slide in a certain direction—when the front latch is actuated, the binding may be slid towards the front of the ski and vice versa with the rear latch unit.

To lock the ski-binding in place, the latch units are released by the skier and are elastically forced into the notches. To prevent forward and backward movement, the oppositely facing latch units apply oppositely directed resistive forces due to the orientation of the locking teeth and the notches. In other words, the presence of two latch units prevents forward and backward movement of the ski-binding when the locking teeth thereof are engaged with the notches.

However, a skier must operate one or the other of the latch units to achieve the desired orientation. For example, suppose a skier wishes to move the ski-binding forward, and actuates the front latch unit accordingly. Then, suppose the skier moves the ski-binding too far forward. The skier must then either release the front latch unit first and then actuate the rear latch unit, or actuate the rear latch unit at the same time as the front latch unit.

If the latter is performed, this means that both hands of the skier are used to actuate the latch units. While the ski-binding is provided in a sliding engagement, the ski-binding may nevertheless provide some resistive force to being slid, thus meaning an additional force is required to slide the ski-binding from one position to the other. In either case, the time required to correctly and accurately align the ski-binding can be lengthy.

Moreover, the locking teeth of the prior art are held in place only via the resistive force of the latch unit. In some cases, considerable force may be applied to the latch unit, for example, during falling. This may cause the ski-binding to inadvertently change position. A fine balance is required when determining the resistive force; too weak and the latch unit will inadvertently actuate, too strong and the skier requires additional means to actuate the latch unit.

A need exists, therefore, for a locking mechanism that enables precise and accurate positioning and locking of a ski-binding, and requires minimal input or action from the skier. Moreover, the locking mechanism should be quick to operate and, preferably, not require the use of any tools.

SUMMARY

The problem is solved by a locking mechanism for a ski-binding, the locking mechanism comprising:

- only one lever adapted to be pivoted between an engaged and a disengaged position,
- wherein the lever comprises at least one lug, the at least one lug adapted to engage with a notch formed in a mounting plate in the engaged position,
- wherein the lug is adapted to hold the lever in a non-sliding manner when engaged with the notch, and
- wherein the locking mechanism does not comprise a second lever.

A ski-binding is provided with a locking mechanism adapted to lock the ski-binding in a desired position with respect to a mounting plate. In this regard, the ski-binding is able to slide in a longitudinal direction of the mounting plate. The mounting plate is generally located on a top surface of a ski and includes one or more notches. The notches may take any shape but are preferably the same shape with respect to one another.

The locking mechanism includes only one lever and explicitly does not include a second (or further) lever. The lever is provided with at least one lug located, preferably, on an underside surface of the lever, wherein the lug is adapted to engage one of the notches provided in the mounting plate. The lever is able to be pivoted from a disengaged position, where the lug is not engaged or in contact with the notch, to an engaged position, where the lug is engaged or in contact with the notch. The pivoting of the lever may be realised by attaching the lever at one end to the ski-binding or, preferably, providing the lever and ski-binding as an integral component such that the lever protrudes from the ski-binding. Preferably, the lever is able to be pivoted without the use of any tools or the like, thus meaning that the skier does not have to carry additional weight or equipment with them.

The lug may engage the notch in any number of ways. Preferably, the lug engages the notch in a press fit manner, such that the lug requires some force to be exerted to insert the lug into the notch. In a preferred arrangement, the lever is biased to a disengaged position such that, when movement of the lever is enabled (e.g., by disengaging locking means), the bias of the lever causes the lug to disengage or be removed from the notch. In other cases, some force is required to remove the lug from the notch. In this way, the lever and thus the ski-binding is provided in a non-sliding manner with respect to the mounting plate and ski when the lever is in the engaged position.

Providing only one lever and locking mechanism is advantageous in that a skier who wishes to adjust the position of the ski-binding is provided with only a single component to operate in order to adjust the ski-binding to any desired position, be it forwards or backwards of the current position. Providing only one lever means that a skier is able to spend minimal time actuating the locking mechanism to both disengage and engage the locking mechanism when altering the position of the ski-binding. This decreases the time that a skier spends stationary and also increases the opportunities that a skier may stop and adjust the ski-binding.

In one embodiment, the lug comprises a front-facing surface having a contour similar to a front surface of the notch, and a rear-facing surface having a contour similar to a rear surface of the notch, wherein, when the lug is engaged with the notch, the front-facing surface and the rear-facing surface are adapted to contact the front surface and the rear surface of the notch.

Providing the contours or profiles of the lug and notch in a similar fashion enables the lug to be press fitted into the notch and ensure a rigid engagement of the lug. This means that the lug (and thus the ski-binding) does not move forwards or backwards even when in the engaged position. In some arrangements, the rigid engagement may enable the lug to be held in place via the frictional or compressive forces provided by pushing or compressing the lug into the notch. This provides more resistivity when a single lever is used such that the skier may not inadvertently move the ski-binding when, for example, having adjusted the ski-binding before fixing or tightening the ski-binding. It is also possible that only a part of the front-facing surface and rear-facing surface of the lug match or contact the front and rear surfaces of the notch.

A further embodiment comprises locking means, the locking means adapted to lock the lever in the engaged position when the lever is engaged with the notch.

Providing locking means enables the lever to be locked in the engaged position and thus remove the possibility of the lever being actuated inadvertently, i.e., during skiing. Preferably, the locking means is also actuated without the use of additional tools, such that the skier may simply stop during a run, unlock the locking means, and adjust the position of the ski-binding without the use of tools. The locking means can include any form of means that enables the lever to be locked in the engaged position. Equally, an alternative locking means may be provided that retains the lever in the disengaged position during adjusting the position of the ski-binding.

In one embodiment, the locking means may comprise at least one of a recess and a protrusion, wherein one of the recess or the protrusion is provided at a distal end of the lever and is adapted to engage a recess or protrusion located on the ski-binding when the lever is in the engaged position.

In addition, or alternatively, the locking means preferably comprises a sliding plate, the sliding plate adapted to slide so as to lock the lever in the engaged position when a part of a surface of the sliding plate is positioned over a part of a top surface of the lever.

In a preferred embodiment of the locking means including a sliding plate, the lever is biased to the disengaged position, and the lever is adapted to move against the biasing force into the engaged position when the sliding plate moves from an unlocked position to a locked position.

In a preferred configuration of the sliding plate, the lever is provided so as to be biased in the disengaged position. That is, at least a part of the lever may be provided biased away from the notches of the mounting plate or the horizontal plane of the ski-binding. In such an arrangement, an upper surface of the lever may be provided at an angle with respect to the horizontal plane of the ski-binding. The sliding plate may be provided in an unlocked position that allows the lever to pivot. This unlocked position may be realised by providing the sliding plate such that it does not engage or come into contact with the lever. In the unlocked position, the lever (and thus the ski-binding) is able to be slid along the mounting plate until a desired position is reached where the lug may engage with a corresponding notch of the mounting plate. To lock the lever, the sliding plate may be slid towards the biased lever such that the sliding plate engages a surface (preferably the inclined surface) of the lever. A continued sliding of the sliding plate causes the biased portion of the lever to move in a direction towards the notches of the mounting plate. In other words, a user actuating the sliding plate acts against the biasing force of the lever biased in the disengaged portion to thereby cause the lever to move to the engaged position. The sliding plate may then subsequently be locked by additional means or may simply prevent the lever from moving to the biased disengaged position given the relative frictional forces involved.

Moreover, the lever may additionally or alternatively, comprise at least one of one or more side protrusions and one or more side recesses, the side protrusions or side recesses provided on a side of the lever between the distal end and a proximal end of the lever, the side protrusions and side recesses adapted to engage corresponding protrusions and recesses located in the ski-binding.

The above mentioned locking means enable the lever to be held in the engaged position as discussed above. Each of the locking means has the advantage that the skier may actuate the means by hand, and thus avoids the need for specialised tools. Moreover, any combination of the above locking means may be utilised, i.e., a lever comprising side protrusions, and a sliding plate, for example. While specific embodiments have been detailed above, the invention is not limited to locking means of this nature. Any locking means may be utilised, provided that the locking means is adapted to lock the lever in the engaged position.

In one further embodiment, the lever is adapted to be pivotingly engaged with the ski-binding at a proximal end of the lever, and wherein the lug is positioned between the distal end and the proximal end of the lever.

A pivoting arrangement of the lever provides only one possible direction, and thus one possible direction of force, that the skier must actuate the lever in order to adjust the ski-binding. This is much more intuitive than, for example, a rotary motion of a dial or the like—unless the skier is familiar with the dial, the skier may not be aware of which way to adjust the dial for the desired position of the ski-binding. Providing the lever negates this unfamiliarity with the ski-binding. In addition, the pivoting nature of the lever reduces the number of moving components required, not only for actuation of the locking mechanism, but also for adjustment of the ski-binding.

In some cases, the lever is provided as an integral component with the ski-binding, and is pivoted at a portion between the lever body and the ski-binding. Such a portion may have a weakened region, for example, a region of a decreased thickness or a region made from a more flexible material, so as to allow for the pivoting of the lever.

Alternatively, the proximal end of the lever may comprise one or more hook portions, the one or more hook portions adapted to engage a corresponding attachment portion located on the ski-binding, wherein the hook portions enable pivoting of the lever when attached to the attachment portion of the ski-binding.

Preferably, the one or more hook portions are provided in an alternating arrangement along the proximal end of the lever such that, when viewed along the pivoting axis of the lever, the hook portions form a C-shape or a circular shape, and wherein the one or more hook portions are adapted to be flexible such that the hook portions deform from the pivoting axis when engaging with the attachment portion.

The use of hook portions located on the lever allow for easy attachment and replacement of the lever from the ski-binding, while also allowing for rotational movement around an axis coinciding with the axis of the hook portions. Furthermore, providing the hook portions in an alternating arrangement enables a precise method for removing the lever, thus meaning that the lever is unlikely to be inadvertently removed.

In a further embodiment, the proximal end of the lever is integrally formed with either a mounting block adapted to be fixed to the ski-binding or the ski-binding itself, wherein the proximal end of the lever is adapted to have an increased flexibility compared to the lever and mounting block or ski-binding, thereby allowing pivoting movement of the lever at the proximal end.

In a further embodiment, the front-facing surface of the lug is provided at an angle with respect to the rear-facing surface, wherein, when the lever is actuated from the disengaged position to the engaged position, the front-facing surface is adapted to engage with the front surface of the notch and provide a forward directional force to the lever thereby moving the lever in a rearward direction to align the lug with the notch.

Providing an angled portion of the front side of the lug means that, should the skier move the binding too far forward or backward, the interaction of the angled surface with the notch forces the lever and thus the ski-binding to the appropriate location on the mounting plate, i.e., such that the lug is aligned with the notch. This means that the skier does not have to precisely align the ski-binding with the notches but may align the ski-binding within a certain tolerance.

In a further embodiment, the lug is adapted to be engaged with the notch in a water-tight manner when in the engaged position. Preferably this is realised by sizing the profiles of the notch and lug to be similar. Providing a water-tight engagement between the notch and the lug ensures that snow and/or dirt cannot enter between the surfaces of the notch and lug. In the case of snow, the snow can freeze when trapped between the lug and notch, thus meaning that a skier must apply larger forces to the lever in order to remove the lever from the engaged position.

In one embodiment, the rear-facing surface of the lug comprises one or more grooves, the grooves adapted to provide a weakening in the rear-facing surface of the lug such that the lug is adapted to be compressed and/or flexed around the axis of the grooves. Providing these grooves enables the lug to be flexed when a skier presses the lug into the notch, thereby aiding the insertion of the lug and reducing the force required to compress the lug.

In another embodiment, the lever may be provided with an indent portion sized and shaped to receive at least a fingertip of an operator of the lever, thereby enabling the operator to grasp the lever when in the engaged position and actuate the lever to the disengaged position. The indent portion is not particularly limited in design or shape.

The problem is also solved by a ski-binding adapted to receive only one locking mechanism according to any of those discussed above, wherein the ski-binding is adapted to be slidingly engaged with the mounting plate and, when the lug is engaged with the notch in the locked position, is adapted to be held in a non-sliding manner, wherein the ski-binding is not adapted to receive a second locking mechanism.

The problem is also solved by a ski-binding comprising only one locking mechanism according to any of those discussed above, wherein the ski-binding is adapted to be slidingly engaged with the mounting plate and, when the lug is engaged with the notch in the locked position, is adapted to be held in a non-sliding manner, wherein the ski-binding does not comprise a second locking mechanism.

In one embodiment of the ski-binding, when the lever is in the disengaged portion, the ski-binding is adapted to slide in a forward and rearward direction with respect to the mounting plate.

In a preferred embodiment, the ski-binding further comprises a lever-receiving hole adapted to receive the lever, and wherein the lever-receiving hole is adapted to pivotingly provide the lever at one end of the lever-receiving hole.

Preferably, the lever-receiving hole is provided in a top surface of the ski-binding such that a top surface of the lever, when the lever is in the engaged position, is provided flush with the top surface of the ski-binding. In this way, an edge of the lever does not protrude from the surface of the ski-binding, meaning that the lever cannot be caught on obstacles or by the skier's boot and actuated unintentionally. In a preferred arrangement, the lever-receiving hole is located at a position under the skier's boot, when the skier's boot is engaged with the ski-binding.

The lever may also be provided as an integral part of the ski-binding, the lever provided at an end of the lever-receiving hole and adapted to pivot at that end.

In one embodiment, the ski-binding further includes at least one of:

one or more recesses and/or one or more protrusions located at an end of the lever-receiving hole opposite to where the lever-receiving hole is adapted to pivotingly provide the lever, wherein the one or more recesses and one or more protrusions are adapted to receive corresponding recesses or protrusions located on the lever;

sliding plate accommodating means that is adapted to accommodate a part of a sliding plate when the lever is in the engaged position, or accommodate the entire sliding plate when the lever is in the disengaged position;

one or more side protrusions and one or more side recesses located at a side portion of the lever-receiving hole and adapted to receive side protrusions and side recesses of the lever; and an edge portion adapted to receive side clips provided on the lever.

Depending upon the explicit configuration of the lever, and more particularly, the locking means of the lever, the ski-binding and the lever-receiving hole may comprise reciprocal components adapted to interact with the locking means of the lever.

The present invention also provides a mounting plate for use with the locking mechanism described above or the ski-binding described above, wherein the mounting plate comprises only one set of notches, and wherein the set of notches comprises notches having the same shaped profile and orientated in the same direction.

The present invention also provides a system including only one locking mechanism, the ski-binding, and the mounting plate described above, wherein the ski-binding is adapted to slidingly engage with the mounting plate and the only one lever of the locking mechanism is adapted to engage with one of the one set of notches of the mounting plate, thereby preventing sliding movement of the ski-binding.

These and other aspects of the invention will be apparent from and elucidated with reference to the embodiments described hereinafter.

DETAILED DESCRIPTION

Figure 1A:
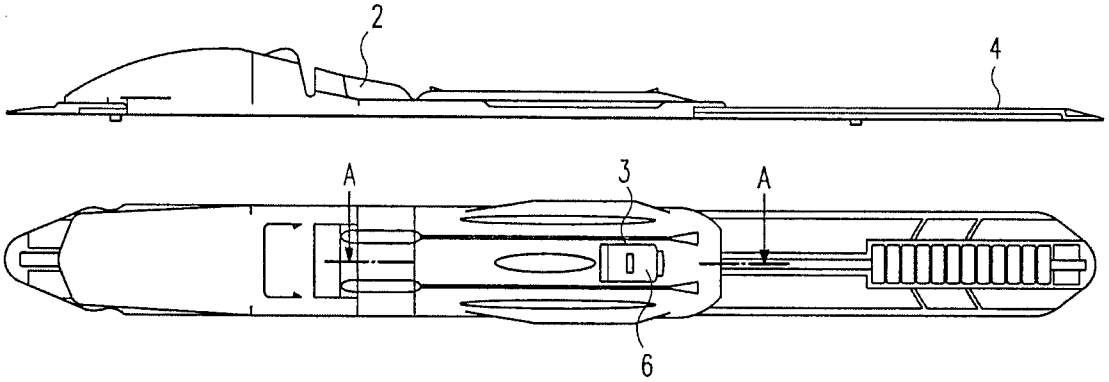
FIG. 1 shows an exemplary ski-binding located on a mounting plate, and one example of a locking mechanism.
Figure 1C:
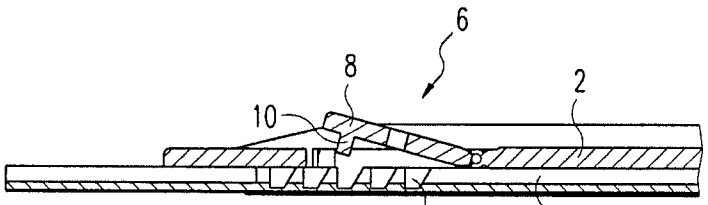
Figure 1B:
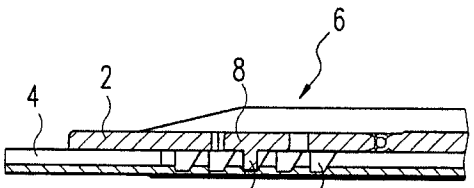

FIG. 1(*a*) shows an exemplary arrangement of a ski-biding 2 engaged with a mounting plate 4 in both a side-on and top-down view. Generally speaking, the ski-binding 2 is provided in such a manner so as to be able to slide along a longitudinal axis of the mounting plate 4 and subsequently be locked at a certain position. The general mounting of a ski-binding 2 with respect to a mounting plate 4 is known in the art and will not be described in detail herein. In principle, however, the ski-binding 2 is provided with a C-shaped lip or similar component that engages a lip of the mounting plate 4. The mounting plate 4 may be a separate component from a ski and mounted thereto, or the mounting plate 4 may be integrally formed on a top surface of the ski.

According to the present invention, the ski-binding 2 is provided with a single locking mechanism 6 that is adapted to hold and/or lock the ski-binding in a desired position. As shown in FIG. 1(*a*), the locking mechanism 6 is provided in an attached arrangement with the ski-binding 2. In some embodiments, the locking mechanism 6 may be a separate, detachable component from the ski-binding 2 and may be fixed to the ski-binding 2 accordingly. In a preferred arrangement, the locking mechanism 6 may be an integral component with the ski-binding 2; that is, the locking mechanism 6 and the ski-binding 2 may be one and the same component made from the same material and by one moulding process.

As shown in more detail in FIGS. 1(*b*) and 1(*c*), the locking mechanism 6 includes a lever 8, which itself includes a lug 10. FIG. 1(*b*) shows an engaged position of the lever 8 according to the present invention, while FIG. 1(*c*) shows a disengaged position of the lever 8. In the engaged position, the lever 8, and more specifically the lug 10, is engaged with a notch 12 provided on the mounting plate 2. The lug 10 may be provided at any portion of the lever 8, but is preferably disposed on an underside of the lever 8 and between a distal 24 and proximal end 26 thereof (see FIG. 3).

The mounting plate 2 includes a plurality of notches 12 spaced apart from each other in a longitudinal direction of the mounting plate 2 as shown in the Figures. In essence, the lug 10 may be engaged with any one of the notches 12, and it should be appreciated that, in order to engage the lug 10 with a different notch 12, the ski-binding 2 is slid in a longitudinal direction (i.e., forwards or backwards) so as to align the lug 10 with the desired notch 12.

In the disengaged position, as shown in FIG. 1(*c*), the lever 8 is positioned away from the notches 12 such that the lug 10 is not in contact with the notches 12 and/or the mounting plate 2. In this position, the ski-binding 2 is able to be slid in a longitudinal direction. The ski-binding 2 may have some resistive force to such a motion owing to the interaction between the ski-binding 2 and the mounting plate 4; in other words, the ski-binding 2 may require some force in a longitudinal direction in order to position the ski-binding accordingly.

In the engaged position, as shown in FIG. 1(*b*), the lug 10 of the lever 8 is pressed or forced into the corresponding notch portion 12. In some embodiments, the interaction between the lug 10 and the notch 12 is sufficient to prevent the lever 8 from inadvertently moving during use of the ski and ski-binding 2. In any case, when the lug 10 is engaged with the notch 12, the ski-binding 2 is prevented from sliding in a longitudinal direction. In other words, the lug 10 holds the lever 8 in a non-sliding manner when engaged with the notch 12.

The lever 8 may be biased to a certain position. In a preferred arrangement, the lever 8 is biased into a disengaged position, i.e., the position as seen in FIG. 1(*c*). In this case, when no external force is applied to the lever 8 or when the lever 8 experiences no resistance, the lever 8 is disengaged from the notch 12. Alternatively, the lug 10 may be pressed into the notch 12 via an elastic or resistive force generated by the lug 10 at a pivoting end of the lever. That is, the lever 8 may be formed with an "at rest" position that corresponds to the engaged position, and thus the lever 8 returns to this position once the skier releases the lever 8. That is, the lever 8 may be biased to the engaged position. Alternatively, the lever 8 may have no particular bias and the lug 10 may be forced into the notch 12 by the skier and the compression force between surfaces of the lug 10 and surfaces of the notch 12 retain the lug within the notch 12.

Preferably, the ski-binding 2 includes a lever-receiving hole 3 that is adapted to receive the lever 8 when the lever 8 is in the engaged position. In one arrangement, a top surface of the lever 8 is provided flush with a top surface of the ski-binding 2 when the lever 8 is in the engaged position. This is advantageous because the edges of the lever 8 are not exposed in such an arrangement and are thus not prone to being caught or knocked by various obstacles or by the ski-boot of the skier.

It should be noted that, although only one lug 10 is shown in FIGS. 1(*b*) and 1(*c*), more than one lug 10 may be provided. A plurality of lugs 10 may be provided in any arrangement to achieve the desired effect of the invention. For example, the plurality of lugs 10 may be positioned such that all the lugs 10 interact with the same notch 12, that is, the plurality of lugs 10 have the same profile as viewed in FIGS. 1(*b*) and 1(*c*) but are spaced apart from each other in a width direction of the lever 8. Alternatively or additionally, the lugs 10 may be positioned at different longitudinal points of the lever 8 such that the plurality of lugs 10 interacts with more than one notch 12. Equally, it should also be appreciated that several columns of notches 12 may be provided in the mounting plate 4.

According to the present invention, only one locking mechanism 6 and thus only one lever 8 is provided to the ski-binding 2. That is, the present invention explicitly does not include a second or more locking mechanisms 6 or levers 8. This is a fundamental concept of the present invention, as the provision of only a single locking mechanism 6 enables a skier to more quickly and efficiently alter the position of the ski-binding 2 on the mounting plate 4, thereby reducing the time spent adjusting the ski-binding 2. Herein, a skier is given as the person that alters the ski-binding 2 for ease of reading, however, any person, such as a technician or the like, may equally alter the position of the ski-binding 2.

It should also be noted that the lever 8 may face either direction on the ski-binding 2. That is, for example, the pivot point of the lever 8 may be positioned forward of the movable end of the lever 8 in relation to the ski-binding 2, in which case the lever 8 may be said to be rearward facing. Conversely, the pivot point of the lever 8 may be positioned behind the moveable end of the lever 8 in relation to the ski-binding 2, in which case the lever 8 may be said to be forward facing. Whether the lever 8 is forward or rearward facing may depend upon the intended use of the ski-binding, i.e., the type of skiing or certain techniques. For example, a rearward facing lever 8 may be preferential for resisting certain forces when used during skiing, i.e., the counterforce of the skier when moving the ski backwards. Although the Figures herein may show the lever 8 in one or the other direction, it should be appreciated that any of the directions may be used and the position of the lever 8 is not limited in this regard.

Figure 2:
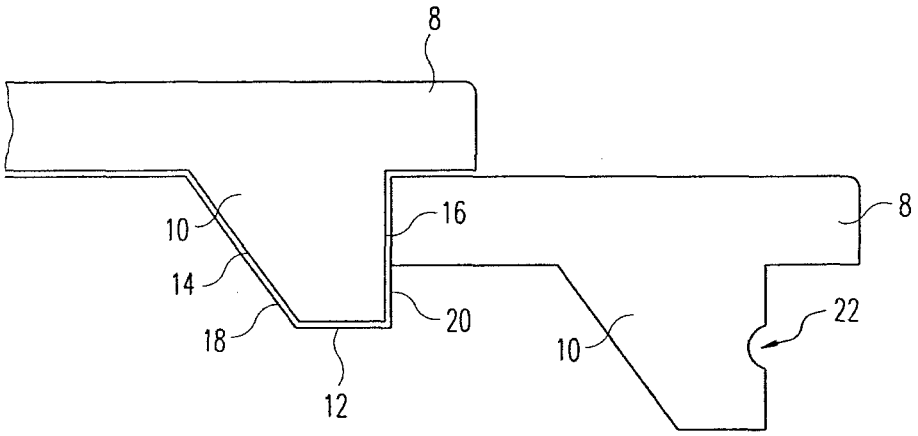
FIG. 2 shows an exemplary lug profile of the lug of a lever.

FIG. 2 shows one type of lug profile and corresponding notch profile. In a preferred arrangement, the profiles of the lug 10 and the notch 12 are almost identical in shape such that a tight fitting can occur between the two. The lug 10 generally includes a front-facing surface 14 and a rear-facing surface 16, wherein the use of "front" and "rear" generally refer to the front and rear directions of the ski respectively. While this terminology is used herein, it should be realised that the front and rear directions of the lug 10 may be reversed with respect to the travelling direction of the ski.

The notch 12 may also include a front surface 18 and a rear surface 20. In a preferred embodiment, the front-facing surface 14 and the front surface 18, in addition to the rear-facing surface 16 and the rear surface 20, are in contact with each other when the lug 10 is pressed into the notch 12. In one embodiment, the lug 10 may be made from a compressible material and may be formed so as to have a profile that is larger than the profile of the notch 12. In this arrangement, the lug 10 exerts a compressive force on the surfaces 18, 20 of the notch 12 which may prevent movement or disengagement of the lug 10 from the notch 12.

Preferably, the profiles of the lug 10 and notch 12 are similar, although this does not need to be the case. In this regard, only a part of the front-facing surface 14 and the rear-facing surface 16 may be in contact with the front and rear surfaces 18, 20 of the notch 12.

In one further arrangement, the front-facing surface 14 and the front surface 18 may be provided at an angle with respect to the rear-facing surface 16 and the rear surface 20 as shown in FIG. 2. Providing this angle enables the lug 10 to be eased into the notch 12 when a skier pushes or releases the lever 8. Moreover, the angled portion may be advantageous for locating the lug 10 into the notch 12. For example, if the lever 8 is positioned too far forward, i.e., the ski-binding 2 is too far forward, the front-facing surface 14 of the lug 10 contacts the front surface 18 of the notch 12. During continued actuation of the lever 8, the front-facing surface 14 slides down the front surface 18 and subsequently drags the ski-binding 2 rearwards, thereby aligning the lug 10 correctly with the notch 12.

In some further embodiments, the lug 10 may also be provided with one or more grooves 22 provided along the rear-facing surface 16. Preferably, the grooves 22 are orientated along the width direction of the lug 10 and are essentially formed around an axis. In this regard, the grooves 22 may act as weakened portions of the lug 10 and permit relatively more compression and/or flexion of the lug 10 around the axis of the grooves 22. Such a configuration can aid in the insertion of the lug 10 into the notch 12 and reduce the force required by the skier to perform such, while also maintaining the tight fit with the surfaces 18, 20 of the notch 12.

In a preferred configuration, the interaction of the lug 10 and the notch 12 is provided in a water-tight manner such that snow or the like cannot be disposed between the surfaces of the lug 10 and notch 12 when in an engaged position. In some cases, depending upon the temperature, snow that enters the spaces between surfaces of the lug 10 and notch 12 may freeze therebetween, meaning that the lug 10 becomes much harder to remove from the notch 12. Preventing this is advantageous and means that the skier is always able to remove the lug 10 from the notch 12. Preferably, this is enabled by forming the surfaces of the lug 10 and the surfaces of the notch 12 in such a manner that they contact each other in the engaged position.

Figure 3:
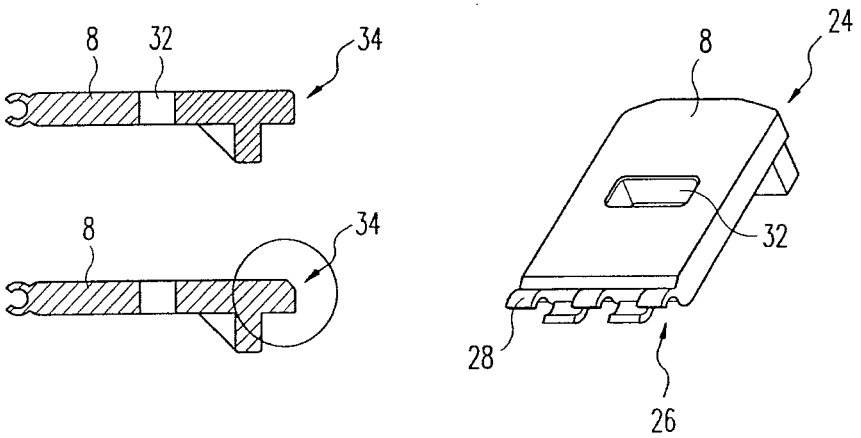
FIG. 3 shows an exemplary lever of the locking mechanism and locking means.
Figure 5:
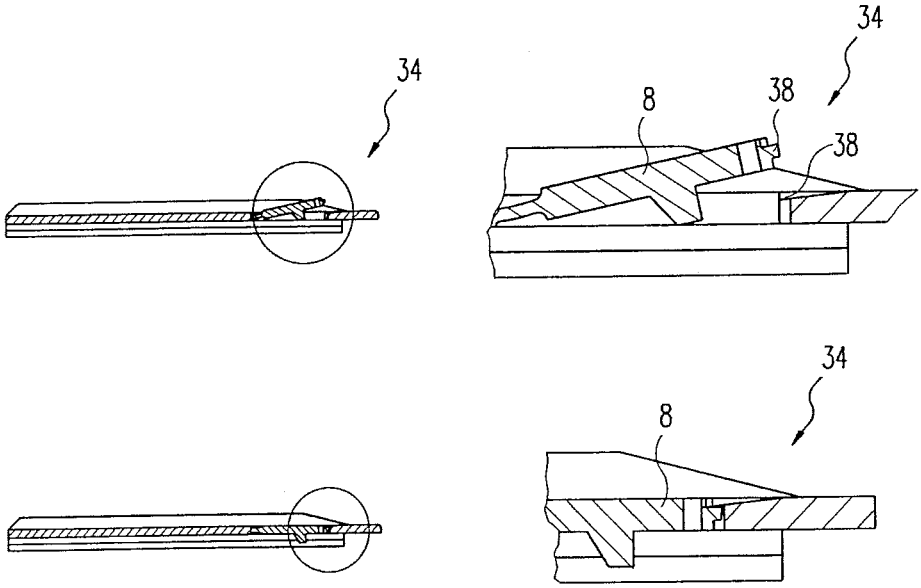
FIG. 5 shows yet more exemplary locking means in both an engaged and disengaged position.

FIG. 3 shows one exemplary type of lever 8. In the example of FIG. 3, the lever 8 is provided as a separate component from the ski-binding 2. As will be discussed in more detail below, the lever 8 is preferably formed as an integral component with the ski-binding 2, thereby reducing the number of components to be produced, i.e., the number of manufacturing steps, in addition to assembly time. FIG. 5 shows one type of integrated lever 8, for example.

Generally speaking, the lever 8 may include a distal end 24 and a proximal end 26. The proximal end 26 is provided as the pivoting end of the lever 8 meaning that the motion of the lever 8 between the engaged and disengaged positions is effectuated at this end. Accordingly, the proximal end 26 also has a pivoting axis which is orientated along a width direction of the lever 8.

In the example of FIG. 3, the lever 8 is provided with hook portions 28 located at the proximal end 26 of the lever 8. The hook portions 28 are adapted to engage with a corresponding attachment portion 30 located on the ski-binding 2 (see FIGS. 4 and 9). The hook portions 28 may take any form depending upon the corresponding attachment portion 30. In the example of FIG. 3, the hook portions 28 are provided in an alternative up-down fashion—that is, the hook extends from a middle point of the proximal end 26 to a lower point and back to the middle point (albeit extended from the proximal end 26) in the down arrangement, and extends from a middle point of the proximal end 26 to an upper point and back to the middle point (albeit extended from the proximal end 26) in the up arrangement.

The hook portions 28 may be provided in an alternating fashion along the pivoting axis or proximal end 26 so as to enable a clamping effect with the attachment portion 30. To this end, when viewed along the pivoting axis, the hook portions 28 form a C-shape or a circular shape. In a preferred arrangement, the gap between the ends of the C-shape is less than twice the radius of curvature of the hook portions 28. In this regard, the hook portions 28 may be flexible such that, when pushed towards the attachment portion 30, the hook portions deform away from the pivoting axis to allow the attachment portion 30 to be located along the pivoting axis. Such an arrangement enables the lever 8 to be stably and pivotably attached to the attachment portion 30.

In some further configurations, the hook portions 28 are provided only in an up or down configuration. Accordingly, the attachment portion 30 of the ski-binding 2 may be provided with inserts that are arranged in such a manner to enable a precise locating and fitting of the lever 8. To remove the lever 8, one must also remove the lever 8 in a precise manner according to the location and/or orientation of the inserts, thus meaning that an inadvertent removal of the lever 8 is not possible.

The lever 8 may also be provided with an indent portion 32. The indent portion 32 is preferably sized and shaped to receive at least a fingertip of the skier. In this way, the skier is provided with a better grip or leverage in order to remove the lever 8 from the engaged position. Further examples of the indent portion 32 and removal means are described later.

The locking mechanism 6 may also be provided with locking means 34. The locking means 34 may be any type of locking means 34 that enables the lever 8 to be locked in the engaged position in such a manner that the lever 8 is not easily displaced from the engaged position. In one arrangement, the locking means 34 may be equivalent to the lug 10 and notch 12 interaction as discussed with respect to FIG. 2; that is, the resistive force provided when inserting the lug 10 into the notch 12 and the corresponding compression of the lug 10.

Figure 4A:
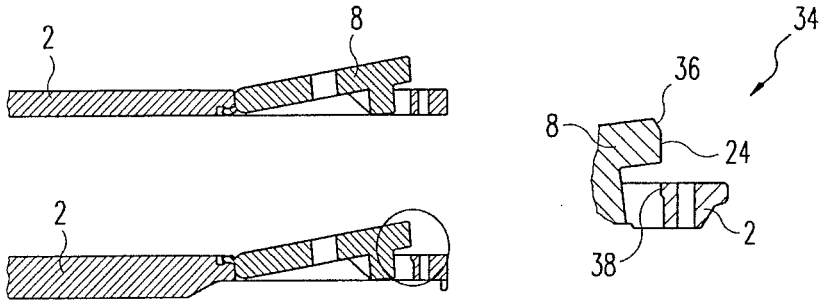
FIG. 4 shows further exemplary locking means in both an engaged and disengaged position.
Figure 4B:
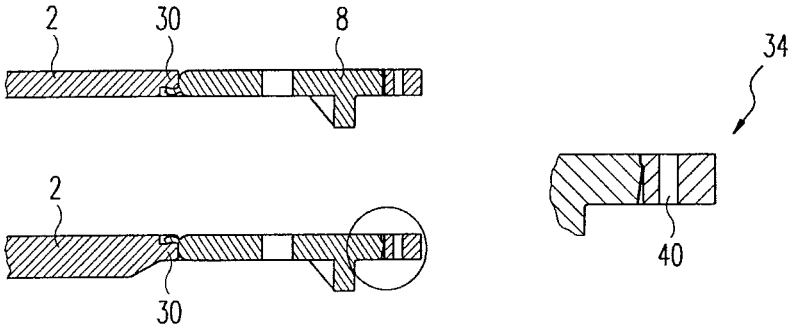

FIGS. 4(*a*) and 4(*b*) show one exemplary locking means 34. FIG. 4(*a*) shows the locking means 34 of the example in an unlocked position when the lever 8 is in the disengaged position, and FIG. 4(*b*) shows the locking means 34 of the example in a locked position when the lever 8 is in the engaged position.

The locking means 34 of this example is realised by at least one recess 36 and at least one protrusion 38. In FIGS. 4(*a*) and 4(*b*), a recess 36 is provided at the distal end 24 of the lever 8 and a corresponding protrusion 38 is provided on the ski-binding 2. Preferably, the protrusion 38 is provided within the lever-receiving hole 3 of the ski-binding 2 and at an end thereof that is positioned furthest from the pivoting axis of the lever 8. As shown in FIG. 4(*b*), when the lever 8 is actuated to the engaged position, the recess 36 and the protrusion 38 interact and essentially lock the lever 8 in the engaged position.

In this regard, either the distal end 24 of the lever 8 or the protrusion 38 may be provided with some flexibility which enables deformation of the recess 36 or protrusion 38 when the lever is pressed into the engaged position. However, the level of flexibility must not be too great so as to allow the lever 8 to inadvertently move to the disengaged position. Therefore, the skier must apply an additional force to the lever 8 when positioning the lever 8 in the engaged position in order to overcome the resistive forces provided by the flexible recess 36 or protrusion 38. In one arrangement, the ski-binding 2 is provided with a gap 40 that accommodates the flexion of the protrusion 38 and/or the element of the ski-binding 2 that the protrusion 38 is provided on.

Although the recess 36 is provided on the lever 8 and the protrusion 38 is provided on the ski-binding 2 in FIGS. 4(*a*) and 4(*b*), the recess 36 may be positioned on the ski-binding 2 and the protrusion 38 may be provided on the lever 8. Equally, any number of protrusions 38 and recesses 36 may be provided as the locking means 34, and each component (lever 8 or ski-biding 2) does not have to have only one of the recesses 36 or protrusions 38—any combination of these may be provided on one component.

FIG. 5 shows a further exemplary locking means 34 comprising a number of protrusions 38. As shown in FIG. 5, the protrusions 38 are provided on the distal end 24 of the lever 8 and the corresponding surface of the lever-receiving hole 3. In a similar manner to the arrangement of FIG. 4, the lever 8 is actuated towards the engaged position and the protrusion 38 of either the lever 8, the lever-receiving hole 3, or both, are adapted to flex and allow access to the position shown in the lower-right of FIG. 5.

This arrangement is preferable when the lever 8 is arranged as a single piece component with the ski-binding 2. As shown in FIG. 5, the lever 8 may be biased to a disengaged position, meaning that when the lever 8 is placed in the engaged position, the lever 8 applies an upward force to the protrusion 38 of the lever-receiving hole 3. This means that a force is applied between the protrusions 38 which retains these protrusions 38 in a constant contact arrangement.

In essence, the configuration of the protrusions 38 and recesses 36 is not particularly limited. The shapes of either of these components are not limited to those described above, and may take any shape that allows for the locking nature of these components. Equally, the distal end 24 and the surface of the lever-receiving portion 3 opposite to the pivoting axis are not limited in their shape. For example, the surfaces may be inclined, as shown with regards to FIGS. 4(*a*) and 4(*b*) and the distal end 24 of the lever 8.

Figure 6A:
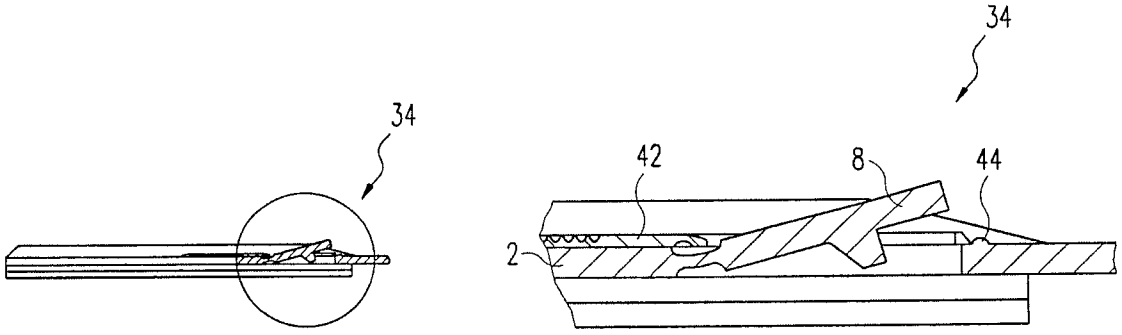
FIG. 6 shows an exemplary locking means including a sliding plate.
Figure 6B:
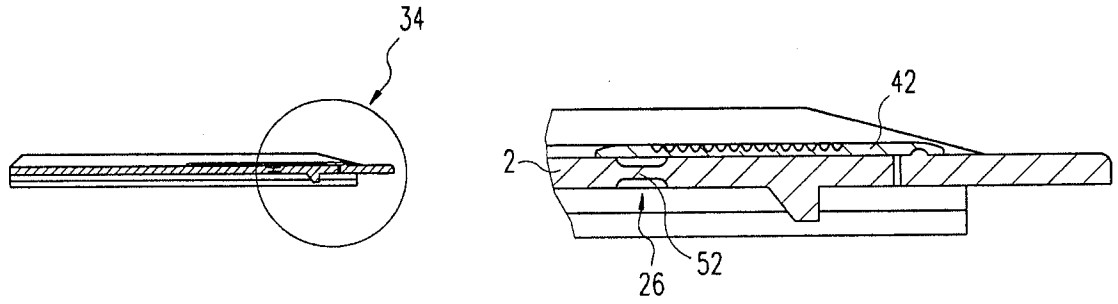
Figure 7A:
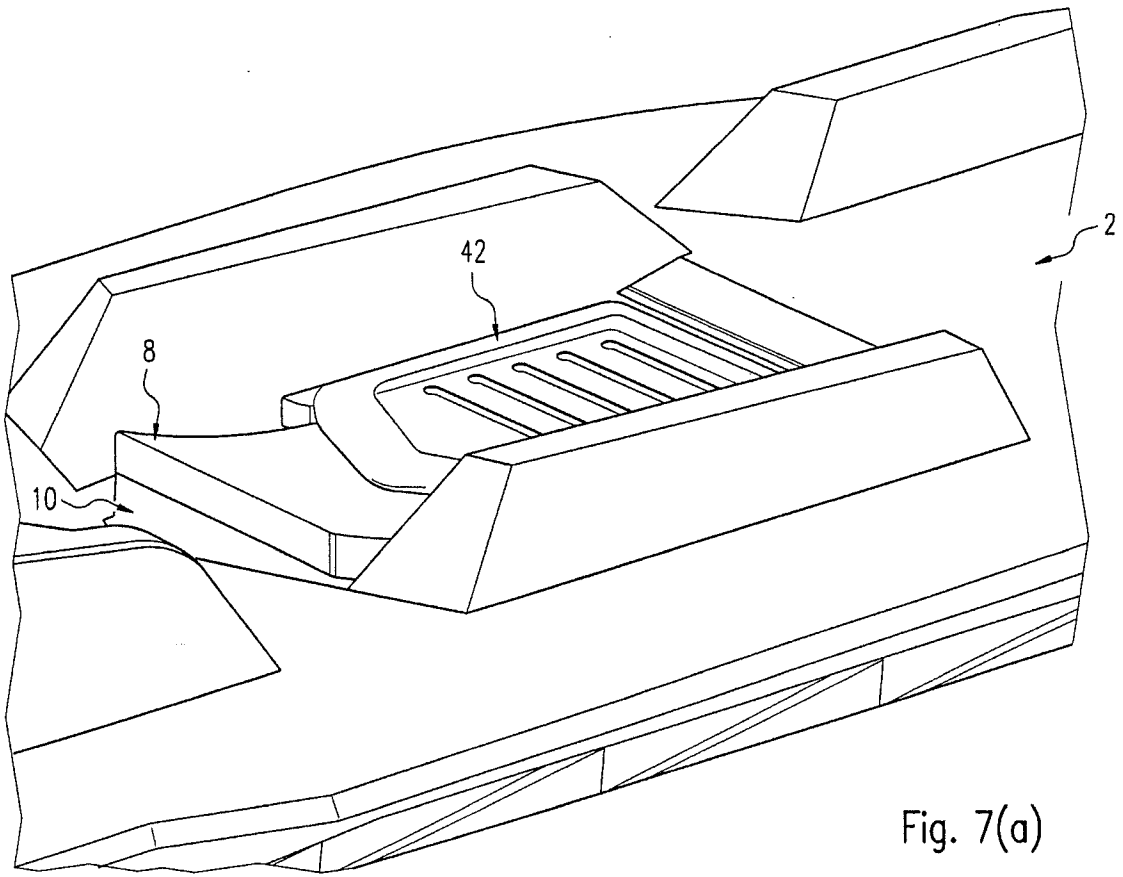
FIG. 7 shows several arrangements of a lever biased in the disengaged position.
Figure 7D:
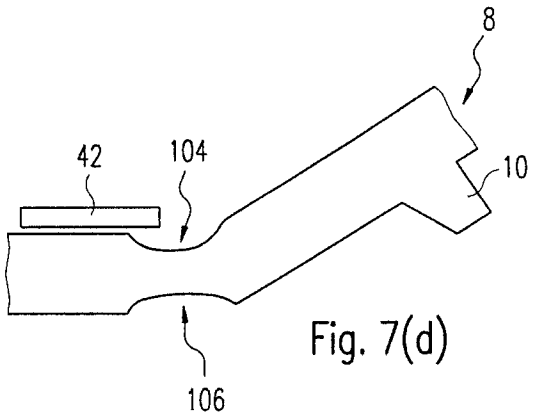
Figure 7B:
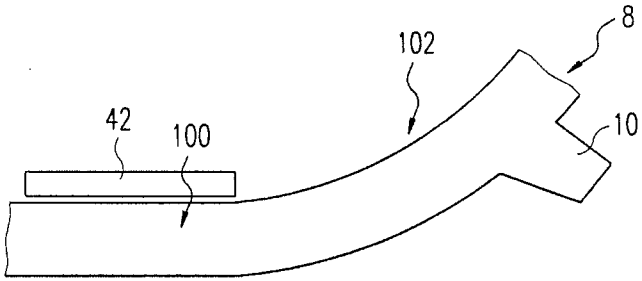
Figure 7C:
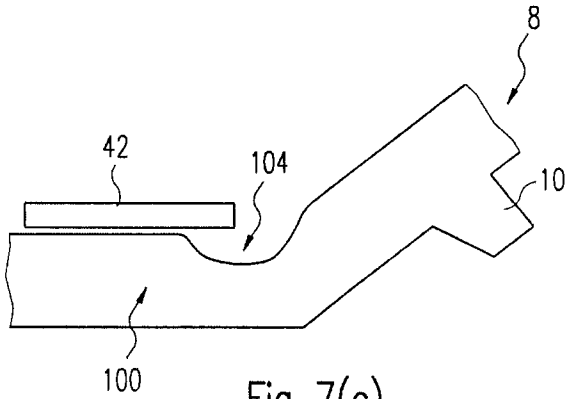
Figure 7F:
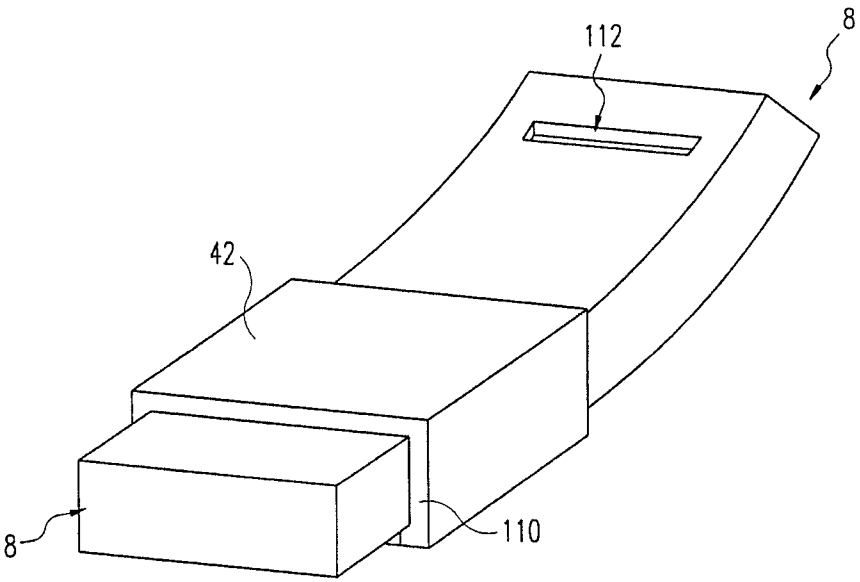
Figure 7E:
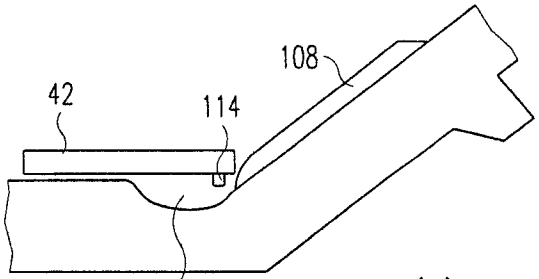

FIGS. 6(*a*) and 6(*b*) show yet another embodiment of the locking means 34. In this embodiment, the locking means 34 comprises a sliding plate 42, wherein the sliding plate 42 is able to be slid from a first position to a second position. In FIG. 4(*a*) the sliding plate 42 is provided in an unlocked position, and the lever 8 is shown in the disengaged position. In FIG. 4(*b*), the sliding plate 42 is shown in a locked position and the lever 8 is shown in an engaged position. In this embodiment, the sliding plate 42 is actuated when the lever 8 is already in the engaged position, thereby acting as a means to prevent the lever 8 from actuating to the disengaged position.

The sliding plate 42 may be provided initially on the ski-binding 2 as is shown in FIG. 6(*a*). Alternatively, the sliding plate 42 may be provided on the top surface of the lever 8 in the disengaged position. For the sliding plate 42 to lock the lever 8 in the engaged position, the sliding plate 42 must have a part of the lower surface thereof positioned over a part of the top surface of the lever 8 and a part of the ski-binding 2. In other words, the sliding plate 42 should be positioned such that it interacts with both the lever 8 and the ski-binding 2.

The sliding plate 42 may be received in a cavity or the like located in the ski-binding 2, or it may be received on a top surface of the ski-binding 2. Equally, some form of housing may be provided to store the sliding plate 42 when the sliding plate 42 is not in use, i.e., when it is in the unlocked position. In one embodiment as shown in FIGS. 6(*a*) and 6(*b*), the ski-binding may be provided with a protrusion 44 adapted to engage the sliding plate 42. That is, the protrusion 44 may engage a corresponding recess in the sliding plate 42 in order to retain the sliding means 42 in the locked position. Accordingly, the sliding plate 42 may be provided with some flexibility to allow the sliding plate 42 to be correctly aligned with the protrusion 44.

Although the sliding plate 42 is shown with a lever 8 that is integrally formed with the ski-binding 2, the sliding plate 42 may be provided with a separate lever 8 that is attached to the ski-binding 2.

A preferred embodiment of the leaver 8 and locking means 34 is shown in FIG. 7. FIG. 7(*a*) depicts a lever 8 that is biased in the disengaged position. In other words, the lever 8 has an "at rest" position in which the lug 10 is not engaged with the notch 12. A sliding plate 42 acting as the locking means 34 is also shown in the unlocked position, meaning that the ski-binding 2 in FIG. 7(*a*) is able to be slid (along the longitudinal direction of the mounting plate 4) to a desired position. When the locking plate 42 is in the unlocked position, the lever 8 moves into the disengaged position as a result of the biasing force provided. The biasing force may be provided by the material of the lever 8, e.g., such as an elastic material or the like, by a spring or mechanical means, or by a predefined shape of the lever 8. Preferably, the lever 8 is integrally formed with the ski-binding 2, although it may be that the lever 8 is provided as a separate component and attached thereto.

Generally, in the embodiment of FIG. 7(*a*), when the sliding plate 42 is moved from an unlocked to a locked position, the sliding plate 42 engages a part of the lever 8 that is biased in the disengaged position. For example, a top surface of the lever 8 is inclined with respect to a horizontal plane of the ski-binding 2 in the disengaged position and a leading edge of the sliding plate 42 engages and slides along the top surface of the lever 8 when the sliding plate 42 is moved to the locked position. In this way, as the sliding plate 42 is moved against the biasing force of the lever 8 when actuated by a skier, the lug 10 of the lever 8 is urged into the corresponding notch 12 as the lever 8 essentially aligns with the longitudinal axis of the ski-binding 2.

FIGS. 7(*b*) to 7(*d*) show three exemplary types of levers 8 that are provided and biased in the disengaged position. FIG. 7(*b*) shows a lever 8 of uniform thickness comprising a fixed portion 100 and a curved portion 102. The fixed portion 100 may be fixed to the ski-binding 2, for example, using screws or other fastening means. Alternatively, the fixed portion 100 may actually be an integral part of the ski-binding 2, such that the curved portion 102 essentially extends from the ski-binding 2. The lever 8 of this embodiment is preferably flexible. The lever 8 may be formed from an elastic or rubber material, or any other material that offers an appropriate biasing force. In some arrangements, the lever 8 may be made from two or more layers of materials, each with different elastic properties stacked on top of one another thereby providing the curved portion 102 in a biased manner. In this embodiment, when the sliding plate 42 moves towards the lug 10, i.e., towards the locked position, the leading edge of the sliding plate 42 engages with the top surface of the lever 8 and transfers the sliding motion or force of the sliding plate 42 into a downward force acting on the lever 8. In this case, the lever 8 effectively straightens out and, in the process, causes the lug 10 to move towards the corresponding notch 12. Furthermore, in this embodiment, the locked position of the sliding plate 42 may correspond to either a part or the whole of the sliding plate 42 being positioned over a top surface of the lever 8. In some cases, the sliding plate 42 does not need to be of an equivalent or greater length to the lever 8.

FIG. 7(*c*) shows a further example of a lever 8. In this example, the lever 8 is manufactured in an appropriate shape giving a certain biased position—FIG. 7(*c*) shows an inclined L-shape, although the actual shape is not limited to that shown in FIG. 7(*c*). In other words, the lever 8 may be manufactured to a specific shape corresponding to the disengaged position. When actuating the sliding plate 42, the lever 8 may deform to enter the engaged position. To provide some flexibility, a recess 104 may be provided at an appropriate location. In FIG. 7(*c*), the recess 104 allows for the lever 8 to pivot when the sliding plate 42 engages with the top surface of the lever 8. In this case, the lever 8 may be made from a rigid material such that the majority of the flexibility comes from the provision of the recess 104. Again, a fixed portion 100 of the lever 8 may also be provided wherein this fixed portion 100 is either fixed to the ski-binding 2 or is integrally provided with the ski-binding 2.

In order to increase the amount of flexibility, a second recess 106 may also be provided as shown in FIG. 7(*d*). In this regard, the overall design of the lever 8 is similar to that in FIGS. 5 and 6 in that a weakened portion 26 of the lever 8, discussed in more detail below, is provided.

In all of the above examples, the lever 8 may be provided with one or more guides or tracks 108. An example of such a track 108 is seen in FIG. 108, although the track 108 is not limited to this configuration. In one arrangement, the track 108 is disposed on the top surface of the lever 8 and is configured to engage with the leading edge of the sliding plate 42. In this way, when the sliding plate 42 contacts the top surface of the lever 8, the leading edge contacts and is guided by the track 108. This may reduce the wear on the top surface of the lever 8 and of the sliding plate 42 thus providing a locking mechanism 6 with a longer operational lifetime, and may also provide for a more universal application of the force to the lever 8. Any number of tracks 108 may be employed along the width of the lever 8, and the tracks 108 are not particularly limited in size and/or shape.

Although not shown, the leading edge of the sliding plate 42 may additionally or alternatively be provided in a sloped or curved manner. That is, for example, the leading edge may be provided as a slope with a gradient that corresponds to the gradient of the biased lever 8. In this way, when the leading edge of the sliding plate 42 contacts the top surface of the lever 8, or the track(s) 108, a maximal contact area between the leading edge and the top surface or track(s) 108 is provided. This may reduce the wear on the lever 8, leading edge of the sliding plate 42, and/or the track(s) 108. In another configuration, the leading edge may be curved so as to gradually contact the lever 8 or track(s) 108.

The sliding plate 42 may also be locked once in the locked position; that is, once the sliding plate 42 locks the lever 8 in the engaged position, the sliding plate 42 may itself be locked in order to prevent movement of the sliding plate 42. In this regard, the protrusion 44 of FIG. 6 may be provided to engage the sliding plate 42. Alternatively, the lever 8 may comprise an indented portion 112 on its top surface. A tooth 114—see FIG. 7(*e*)—provided on the sliding plate 42, preferably at a lower surface thereof, may engage the indented portion 112 once the sliding plate 42 is in the locked position. The interaction between the tooth 114 and the indented portion 112 is preferably sufficient to prevent the sliding plate 42 from becoming unlocked during use of the ski, but should not be too strong such that a skier requires excessive force to move the sliding plate 42.

Although only one indented portion 112 is shown in FIG. 7(*f*), several indented portions 112 may be provided sequentially in the sliding direction of the sliding plate 42. In one configuration, a number of indented portions 112 are provided such that the top surface of the lever 8 may have a serrated-pattern whereby the tooth may engage with one of the troughs of the serrated-pattern. Equally, one or more teeth 114 may also be provided to the sliding plate 42.

In another configuration, the sliding plate 42 may engage with a recess provided in the ski-binding 2. A longitudinal recess may be provided on the same plane as the sliding plate 42 such that the sliding plate 42 slides into the recess when actuated into the locked position. This may lead to an arrangement where a part of the sliding plate 42 covers a part of the surface area of the lever 8 and a part of the ski-binding 2. The lever 8 is therefore unable to return to the biased disengaged position owing to this arrangement.

The sliding plate 42 is preferably a substantially planar structure. In some cases, it may be that the sliding plate 42 has one or more edge portions that engage an edge of the lever 8. For example, a C-shaped lip 110 may be provided on the left and right sides of the sliding plate 42 to engage the left and right sides of the lever 8 respectively. An example of a C-shaped lip is shown in FIG. 7(*f*). The edge portions may aid in aligning the sliding plate 42 during movement from the unlocked to the locked position. Alternatively, the sliding plate may engage with longitudinal recesses in the ski-binding, thereby providing a similar advantage.

Figure 8A:
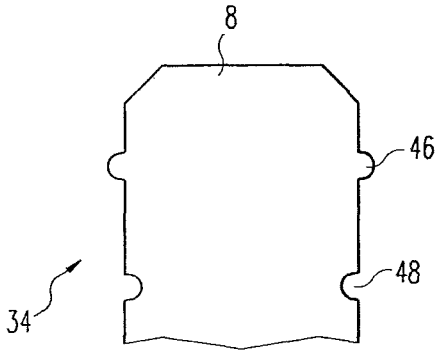
FIG. 8 shows two further locking means.
Figure 8B:
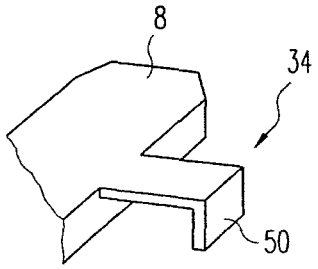

FIGS. 8(*a*) and 8(*b*) show two further exemplary locking means 34. The locking means 34 may comprise side recesses 48 and side protrusions 46 provide on side portions of the lever 8, as shown in FIG. 8(*a*). Any number of side protrusions 46 and side recesses 48 may be provided to the side of the lever 8, wherein the side of the lever 8 is defined as the side surface running between the distal end 24 and the proximal end 26 of the lever 8, and not the top or lower surface of the lever 8. To lock the lever 8 in place, the lever-receiving hole 3 may be provided with corresponding side protrusions 46 and side recesses 48 that align with those provided on the lever 8. Again, the protrusions 46 may be provided with some flexibility to allow appropriate positioning of the lever 8. In an alternative arrangement, the side protrusions 46 and side recesses 48 may be provided on the sliding plate 42. In this way, when the sliding plate 42 is slid into the locked position, the side protrusions 46 and side recesses 48 of the sliding plate may engage with corresponding side protrusions 46 and side recesses 48 provided in the ski-binding 2. This locks the sliding plate 42 and prevents the sliding plate 42 from easily sliding in the longitudinal direction.

FIG. 8(*b*) shows a lever 8 provided with side clips 50, wherein the side clips 50 are adapted to engage with an edge portion of the ski-binding 2 or the mounting plate 4. When the lever 8 is positioned in the engage position, the side clips 50 are arranged such that the edge portion of the ski-binding 2 or mounting plate 4 is located in the open end of the side clip 50. To unlock the lever 8, the side clips 50 may be actuated away from the longitudinal axis of the lever 8 and thus the lever 8 may be raised appropriately.

It should be appreciated that any combinations of the locking means 34 discussed above may be employed in co-operation with each other. For example, a sliding plate 42 may be provided in conjunction with the protrusions 38 and/or side protrusions 46, for instance. Providing a combination realises a fail-safe arrangement, should any of the locking means 34 fail.

As mentioned above, the lever 8 may be integrated with the ski-binding 2. FIGS. 5 and 6 show one possible arrangement of this. In FIG. 6(*b*), the lever 8 is shown with a proximal end 26 including a weakened portion 52, which is provided between the body of the lever 8 and the ski-binding 2. When provided as an integral component, the weakened portion 52 may be made of the same material as the lever 8 and the ski-binding 2. In one embodiment, the weakened portion 52 is formed by reducing the thickness of this region in comparison with the thicknesses of the lever 8 and the ski-binding 2. Inherently, the flexibility is improved at the weakened portion 52 owing to the reduced volume of material present at that region. Pivoting motion of the lever 8 may then be realised by movement of the lever 8 at the weakened portion 52. In some other embodiments, the weakened portion 52 is provided by using a material with a greater flexibility at the proximal end 26 of the lever 8.

When the lever 8 is formed as an integral component with the ski-binding 2, the lever 8 may be biased to the engaged or the disengaged position depending upon the preferred configuration. The present invention is not particularly limited to which position the biasing is directed.

Alternatively, the lever 8 may be a separate component and fixed or attached to the ski-binding 2. In one configuration, the proximal end 26 of the lever 8 is provided with a mounting block and the interface between the mounting block and the proximal end 26 is provided with the weakened portion 52 discussed above. In this arrangement, the mounting block is fixed to the ski-binding 2 and effectively operates in the same manner as the integrated lever 8 discussed in FIG. 6(*b*). However, to replace the lever 8, due to malfunction or breakages for example, or to provide a lever 8 with a different tension, the mounting block allows for removal and attachment of the lever 8 to the ski-binding 2.

Figure 9A:
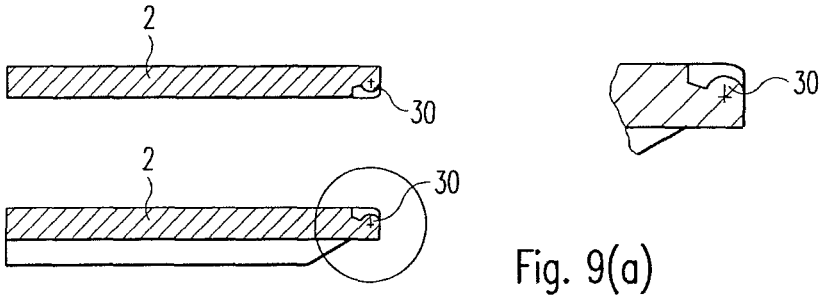
FIG. 9 shows an attachment portion of the ski-binding and an axle receiving portion of the lever for receiving an axle of the ski-binding.
Figure 9B:
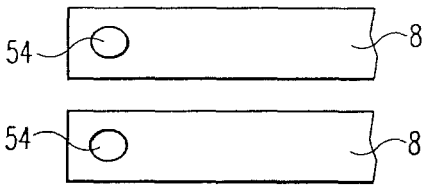
Figure 10A:
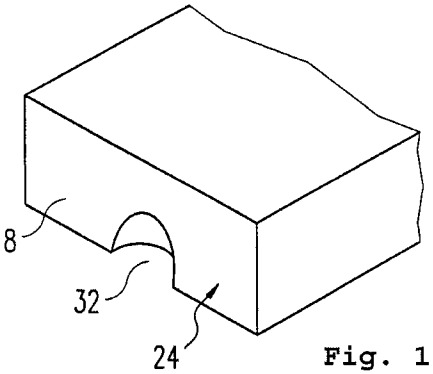
FIG. 10 shows a number of arrangements enabling actuation of the lever by a skier.
Figure 10B:
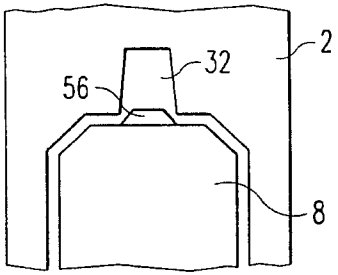
Figure 10C:
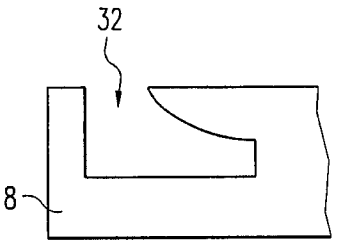
Figure 10D:
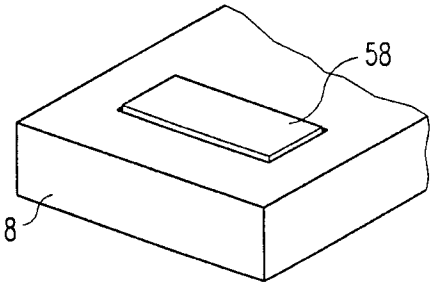
Figure 10E:
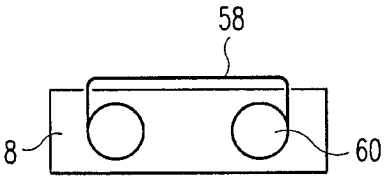

FIG. 9 shows several configurations of the attachment portion 30 of the ski-binding 2 when the lever 8 is provided as a separate component. As already discussed with regards to FIGS. 3 and 4, the attachment portion 30 may comprise circular shaped ridges adapted to receive the hook portions 28 of the lever 8 disposed on the proximal end 26 thereof. As with the hook portions 28, the attachment portion 30 may comprise alternating ridges adapted to receive the alternating up-down hook portions 28. This is shown in FIG. 9(*a*), for example.

An alternative is shown in FIG. 9(*b*), wherein the lever 8 is provided with an axle holding portion 54. The axle holding portion 54 may be provided the entire width of the lever 8 and formed along the pivoting axis of the lever 8. In essence, an axle may be inserted through a hole in the ski-binding 2 and directed through the axle holding portion 54 in order to attach the lever 8 in a pivoting fashion to the ski-binding 2. The pivoting motion may be realised by the lever 8 rotating on the axle, or by the axle rotating in the ski-binding 2 (in this regard, the axle is rigidly held in the axle holding portion 54 of the lever 8).

Many other possible attachment methods or means may be utilised, and the present invention is not limited to those discussed above. Indeed, as long as the attachment means enables the rotatable or pivotable attachment of the lever 8 to the ski-binding 2, any means may be used.

FIG. 10 shows several examples of different structures that the skier may interact with in order to actuate the lever 8. These arrangements are generally not required if the lever 8 is biased to the disengaged position but may be provided if, for example, the lever 8 gets stuck in the engaged position. As discussed above, preferably, the lever 8 is able to be actuated without the use of additional tools, i.e., a skier should be able to actuate the lever 8 using only their finger(s) or hand(s). Given the presence of the locking means 34, a skier is often required to provide a reasonable force to the lever 8 in order to overcome the resistive force provided by the locking means 34.

FIG. 10(*a*) shows the lever 8 provided with an indent portion 32 in the distal end 24 thereof. In the example, the indent portion 32 is a half-hemispherical indent portion 32, although the indent portion 32 is not limited to this. Preferably, this indent portion 32 may be used when the lever 8 is not provided flush with the top surface of the ski-binding 2, i.e., it protrudes from the surface thereof. In operation, the skier may insert a finger or fingertip into the indent portion 32 and apply an upwardly directed force to overcome the force of the locking means 34.

FIG. 10(*b*) shows an indent portion 32 provided in the top surface of the ski-binding 2. This indent portion 32 may be used when the lever 8 is generally flush with the top surface of the ski-binding 2, such that a skier may access a part of the distal end 24 of the lever 8 by sliding a finger or fingertip along the indent portion 32. To aid in the removal of the lever 8, the lever 8 may be provided with the indent portion of FIG. 9(*a*) or, preferably, a lip 56 that allows the skier to apply an upward force thereto.

FIG. 10(*c*) shows the lever 8 comprising an L-shaped indent portion 32. The L-shaped indent portion 32 is generally provided with the opening on a top surface of the lever 8, thereby allowing a skier to effectively insert a finger or fingertip into the body of the lever 8. As shown in the Figure, the lever 8 may be provided with a protrusion that defines the approximate L-shape of the indent portion 32, whereby the protrusion allows for the skier to provide an upward force thereto for actuating the lever 8.

FIGS. 10(*d*) and 10(*e*) show an alternative arrangement. A strap 58 may be provided to the top surface of the lever 8 to enable the skier to grasp the lever 8 and apply a force thereto. In some embodiments, the strap 58 is rigidly affixed to a top surface of the lever 8. However, this may lead to the strap 58 "flapping" and/or "catching" on various items or obstacles. In one embodiment, the strap 58 is provided in a taut arrangement via the use of one or more biasing wheels 60 provided in the body of the lever 8. The biasing wheels 60 may cause the strap 58 to be provided in a taut arrangement, and thus flat against the top surface of the lever 8. When a skier pulls on the strap 58, the biasing wheels 60 may allow unravelling of the strap 58, thus providing the skier with more space between the strap 58 and top surface of the lever 8 in order to accommodate the hand/fingers of the skier. Once released, the strap 58 may be wound back to a taut state via the biasing wheels 60 returning to their initial state.

The present invention may also provide a mounting plate 4 adapted to be used specifically with the locking mechanism 6 or ski-binding 2 including the locking mechanism 6 described above. Conventional mounting plates 4 provide at least two sets of notches 12, one set adapted to receive a front facing lug and one set adapted to receive a rear facing lug, when two locking mechanism 6 are used. As the present invention explicitly employs only one locking mechanism 6 and does not include a second locking mechanism 6, the mounting plate 4 of the present invention requires only one set of notches 12. In this regard, a set of notches 12 is defined as a plurality of notches 12, wherein each notch 12 of the plurality of notches 12 has the same profile and is orientated in the same direction. With reference to FIG. 2, a set of notches 12 includes notches 12 provided with the front surface 18 facing the same direction.

In operation, a skier wishing to alter the position of the ski-binding 2 firstly comes to a stop and may disengage the ski-boot from the ski-binding 2. While it is envisaged that the adjusting of the ski-binding 2 may be made while the ski-boot is attached to the ski-binding 2, particularly for cross-country skis where the ski-boot pivots at the toe portion, it is preferred that the skier will dismount from the skis. Once dismounted, the skier will actuate either the lever 8 or the locking means 34 (if the locking means are the sliding plate 42 or side clips 50, for example). The skier will then either actuate the lever 8 to the disengaged position or allow the lever 8 to return to its natural, biased position, and subsequently push or slide the ski-binding to the desired location. Once positioned appropriately, the skier then either presses the lever 8 in the notch 12 manually or by moving the sliding plate 42 to the locked position, or simply releases the lever 8 if biased to the engaged position into the notch 12. Thereafter, the locking means 34 is actuated, if not already done so by inserting or pressing the lever 8 into the notch 12, and then the skier remounts the skis. The overall process is far quicker than adjusting several different levers at any one time, and provides the skier with the most control for adjusting the ski-binding 2 accurately and precisely.

The present invention provides an easy and quick adjusting mechanism for adjusting the position of a ski-binding 2 by utilising only one locking mechanism 6 including only one lever 8. Because a second lever 8 or a second locking mechanism 6 is not provided, a skier operating the locking mechanism 6 is provided with only one lever 8 to actuate in order to fully adjust the position of the ski-binding 2 to the desired position.

The present disclosure can be summarised according to the following aspects:

1. A locking mechanism for a ski-binding, the locking mechanism comprising:
   - only one lever adapted to be pivoted between an engaged and a disengaged position,
   - wherein the lever comprises at least one lug, the at least one lug adapted to engage with a notch formed in a mounting plate in the engaged position, wherein the lug is adapted to hold the lever in a non-sliding manner when engaged with the notch, and wherein the locking mechanism does not comprise a second lever.

2. The locking mechanism of aspect 1, wherein the lug comprises a front-facing surface having a contour similar to a front surface of the notch, and a rear-facing surface having a contour similar to a rear surface of the notch, wherein, when the lug is engaged with the notch, the front-facing surface and the rear-facing surface are adapted to contact the front surface and the rear surface of the notch.

3. The locking mechanism of any of the preceding aspects, further comprising locking means, the locking means adapted to lock the lever in the engaged position when the lever is engaged with the notch.

4. The locking mechanism of any of the preceding aspects, in particular aspect 3, wherein the locking means comprises at least one of a recess and a protrusion, wherein one of the recess or the protrusion is provided at a distal end of the lever and is adapted to engage a recess or protrusion located on the ski-binding when the lever is in the engaged position.

5. The locking mechanism of any of the preceding aspects, in particular aspect 3 or 4, wherein the locking means comprises a sliding plate, the sliding plate adapted to slide so as to lock the lever in the engaged position when a part of a surface of the sliding plate is positioned over a part of a top surface of the lever.

6. The locking mechanism of any of the preceding aspects, in particular aspect 5, wherein the lever is biased to the disengaged position.

7. The locking mechanism of any of the preceding aspects, in particular aspect 6, wherein the lever is adapted to move against the biasing force into the engaged position when the sliding plate moves from an unlocked position to a locked position.

8. The locking mechanism of any of the preceding aspects, in particular aspect 7, wherein the lever comprises:—a curved portion extending from a distal end to a proximal end, the curved portion being flexible; or at least one recess enabling a rigid part of the lever to pivot at the at least one recess.

9. The locking mechanism of any of the preceding aspects, in particular aspects 5 to 8, wherein a leading edge of the sliding plate is formed as a slope or a curved surface.

10. The locking mechanism of any of the preceding aspects, in particular aspects 5 to 9, wherein a top surface of the lever comprises tracks for making contact with the sliding plate when the sliding plate is moved from the unlocked to the locked position.

11. The locking mechanism of any of the preceding aspects, in particular aspects 5 to 10, wherein a top surface of the lever comprises one or more indented portions and wherein the sliding plate comprises at least one tooth, the at least one tooth adapted to engage the at least one indented portion.

12. The locking mechanism of any of the preceding aspects, in particular any of aspects 3 to 11, wherein the lever comprises at least one of one or more side protrusions and one or more side recesses, the side protrusions or side recesses provided on a side of the lever between a/the distal end and a proximal end of the lever, the side protrusions and side recesses adapted to engage corresponding protrusions and recesses located in the ski-binding.

13. The locking mechanism of any of the preceding aspects, wherein the lever is adapted to be pivotingly engaged with the ski-binding at a proximal end of the lever, and wherein the lug is positioned between a/the distal end and the proximal end of the lever.

14. The locking mechanism of any of the preceding aspects, in particular aspect 13, wherein a/the proximal end of the lever comprises one or more hook portions, the one or more hook portions adapted to engage a corresponding attachment portion located on the ski-binding, wherein the hook portions enable pivoting of the lever when attached to the attachment portion of the ski-binding.

15. The locking mechanism of any of the preceding aspects, in particular aspect 14, wherein the one or more hook portions are provided in an alternating arrangement along the proximal end of the lever such that, when viewed along the pivoting axis of the lever, the hook portions form a C-shape or a circular shape, and wherein the one or more hook portions are adapted to be flexible such that the hook portions deform from the pivoting axis when engaging with the attachment portion.

16. The locking mechanism of any of the preceding aspects, in particular aspect 13, wherein a/the proximal end of the lever is integrally formed with either a mounting block adapted to be fixed to the ski-binding or the ski-binding itself, wherein the proximal end of the lever is adapted to have an increased flexibility compared to the lever and mounting block or ski-binding, thereby allowing pivoting movement of the lever at the proximal end.

17. The locking mechanism of any of the preceding aspects, in particular aspect 16, wherein the lever is provided with a decreased thickness at the proximal end thereof, the decreased thickness providing increased flexibility with respect to the lever.

18. The locking mechanism of any of the preceding aspects, in particular aspect 13, wherein a/the proximal end of the lever is provided with an axle holding portion adapted to receive an axle of the ski-binding, wherein the lever is pivoted via movement of the lever around the axle or via movement of the axle within the ski-binding.

19. The locking mechanism of any of the preceding aspects, in particular aspect 2, wherein a/the front-facing surface of the lug is provided at an angle with respect to the rear-facing surface, wherein, when the lever is actuated from the disengaged position to the engaged position, the front-facing surface is adapted to engage with a/the front surface of the notch and provide a forward directional force to the lever thereby moving the lever in a rearward direction to align the lug with the notch.

20. The locking mechanism of any of the preceding aspects, wherein the lug is adapted to be engaged with the notch in a water-tight manner when in the engaged position.

21. The locking mechanism of any of the preceding aspects, in particular aspect 2, wherein the lug is made from a compressible material such that when the lug is inserted into the notch, the lug compresses and provides a compression force on an inner surface of the notch.

22. The locking mechanism of any of the preceding aspects, in particular aspects 2, 20 or 21, wherein a/the rear-facing surface of the lug comprises one or more grooves, the grooves adapted to provide a weakening in the rear-facing surface of the lug such that the lug is adapted to be compressed and/or flexed around the axis of the grooves.

23. The locking mechanism of any of the preceding aspects, wherein the lever is provided with an indent portion sized and shaped to receive at least a fingertip of an operator of the lever, thereby enabling the operator to grasp the lever when in the engaged position and actuate the lever to the disengaged position.

24. The locking mechanism of any of the preceding aspects, in particular aspects 1 to 22, wherein the lever is provided with a strap, the strap enabling an operator of the lever to grasp the strap when the lever is in the engaged position and actuate the lever to the disengaged position, wherein preferably, the strap is provided in a taut manner via one or more biasing wheels such that, when the strap is in a resting position, the strap is held against a top surface of the lever.

25. The locking mechanism of any of the preceding aspects, in particular any of aspects 3 to 5 and 12, wherein the lever comprises one or more side clips extending from a side surface of the lever, the side surface extending between a/the distal end and a/the proximal end of the lever, wherein the side clips are adapted to engage an edge portion of the ski-binding or the mounting plate.

26. A ski-binding adapted to receive only one locking mechanism of any of aspects 1 to 25, wherein the ski-binding is adapted to be slidingly engaged with the mounting plate and, when the lug is engaged with the notch in the locked position, is adapted to be held in a non-sliding manner, wherein the ski-binding is not adapted to receive a second locking mechanism.

27. A ski-binding comprising only one locking mechanism of any of aspects 1 to 25, wherein the ski-binding is adapted to be slidingly engaged with the mounting plate and, when the lug is engaged with the notch in the locked position, is adapted to be held in a non-sliding manner, wherein the ski-binding does not comprise a second locking mechanism.

28. The ski-binding of aspect 26 or 27, wherein the lever is integrally formed with the ski-binding and wherein the lever is biased to the disengaged position.

29. The ski-binding of aspect 26 or 28, wherein, when the lever is in the disengaged portion, the ski-binding is adapted to slide in a forward and rearward direction with respect to the mounting plate.

30. The ski-binding of any of aspects 26 to 29, wherein the ski-binding further comprises a lever-receiving hole adapted to receive the lever, and wherein the lever-receiving hole is adapted to pivotingly provide the lever at one end of the lever-receiving hole.

31. The ski-binding of any of aspects 26 to 30, in particular aspect 30, wherein the lever is provided as an integral part of the ski-binding, the lever provided at an end of the lever-receiving hole and adapted to pivot at the end.

32. The ski-binding of any of aspects 25 to 29, in particular aspect 30, wherein the ski-binding includes at least one of:

one or more recesses and/or one or more protrusions located at an end of the lever-receiving hole opposite to where the lever-receiving hole is adapted to pivotingly provide the lever, wherein the one or more recesses and one or more protrusions are adapted to receive corresponding recesses or protrusions located on the lever;

sliding plate accommodating means that is adapted to accommodate a part of a sliding plate when the lever is in the engaged position, or accommodate the entire sliding plate when the lever is in the disengaged position;

one or more side protrusions and one or more side recesses located at a side portion of the lever-receiving hole and adapted to receive side protrusions and side recesses of the lever; and an edge portion adapted to receive side clips provided on the lever.

33. The ski-binding of any of aspects 26 to 32, in particular aspect 30, wherein the lever-receiving hole is provided with an attachment region adapted to receive hook portions of the lever.

34. The ski-binding of any of aspects 26 to 33, in particular aspect 30, wherein the lever-receiving hole is provided with an axle, the axle adapted to be engaged with an axle holding portion of the lever.

35. The ski-binding of any of aspects 26 to 34, wherein the ski-biding is provided with a user engagement recess for allowing a user to access an edge portion or an indent portion of the lever so as to enable actuation of the lever from the engaged position to the disengaged position.

36. A mounting plate for use with the locking mechanism of any of aspects 1 to 25 or the ski-binding of any of aspects 26 to 35, wherein the mounting plate comprises only one set of notches, wherein the set of notches comprises notches having the same shaped profile and orientated in the same direction.

37. A system including only one locking mechanism according to any of aspects 1 to 25, the ski-binding according to any of aspects 26 to 35, and the mounting plate according to aspect 36, wherein the ski-binding is adapted to slidingly engage with the mounting plate and the only one lever of the locking mechanism is adapted to engage with one of the one set of notches of the mounting plate, thereby preventing sliding movement of the ski-binding.

The invention claimed is:

1. A locking mechanism for a ski-binding, the locking mechanism comprising:

only one lever adapted to be pivoted between an engaged and a disengaged position, wherein the lever comprises at least one lug, the at least one lug adapted to engage with a notch formed in a mounting plate in the engaged position, wherein the lug is adapted to hold the ski-binding in a non-sliding manner when engaged with the notch, and wherein the locking mechanism does not comprise a second or more lever, and a lock configured to lock the lever in the engaged position when the lever is engaged with the notch, the lock comprising a sliding plate, the sliding plate adapted to slide so as to lock the lever in the engaged position when a part of a surface of the sliding plate is positioned over a part of a top surface of the lever.

2. The locking mechanism of claim 1, wherein the lug comprises a front-facing surface having a contour similar to a front surface of the notch, and a rear-facing surface having a contour similar to a rear surface of the notch, wherein, when the lug is engaged with the notch, the front-facing surface and the rear-facing surface are adapted to contact the front surface and the rear surface of the notch.

3. The locking mechanism of claim 2, wherein the front-facing surface of the lug is provided at an angle with respect to the rear-facing surface, wherein, when the lever is actuated from the disengaged position to the engaged position, the front-facing surface is adapted to engage with the front surface of the notch and provide a forward directional force to the lever thereby moving the lever in a rearward direction to align the lug with the notch.

4. The locking mechanism of claim 2, wherein the lug is made from a compressible material such that when the lug is inserted into the notch, the lug compresses and provides a compression force on an inner surface of the notch.

5. The locking mechanism of claim 2, wherein the rear-facing surface of the lug comprises one or more grooves, the grooves adapted to provide a weakening in the rear-facing surface of the lug such that the lug is adapted to be compressed and/or flexed around the axis of the grooves.

6. The locking mechanism of claim 1, wherein the lever is biased to the disengaged position.

7. The locking mechanism of claim 6, wherein the lever is adapted to move against the biasing force into the engaged position when the sliding plate moves from an unlocked position to a locked position.

8. The locking mechanism of claim 7, wherein the lever comprises:

a curved portion extending from a distal end to a proximal end, the curved portion being flexible; or at least one recess enabling a rigid part of the lever to pivot at the at least one recess.

9. The locking mechanism of claim 1, wherein a leading edge of the sliding plate is formed as a slope or a curved surface.

10. The locking mechanism of claim 1, wherein a top surface of the lever comprises tracks for making contact with the sliding plate when the sliding plate is moved from the unlocked to the locked position.

11. The locking mechanism of claim 1, wherein a top surface of the lever comprises one or more indented portions and wherein the sliding plate comprises at least one tooth, the at least one tooth adapted to engage the at least one indented portion.

12. The locking mechanism of claim 1, wherein the lever comprises at least one of one or more side protrusions and one or more side recesses, the side protrusions or side recesses provided on a side of the lever between a distal end and a proximal end of the lever, the side protrusions and side recesses adapted to engage corresponding protrusions and recesses located in the ski-binding.

13. The locking mechanism of claim 1, wherein the lever is adapted to be pivotingly engaged with the ski-binding at a proximal end of the lever, and wherein the lug is positioned between a distal end and the proximal end of the lever.

14. The locking mechanism of claim 13, wherein the proximal end of the lever comprises one or more hook portions, the one or more hook portions adapted to engage a corresponding attachment portion located on the ski-binding, wherein the hook portions enable pivoting of the lever when attached to the attachment portion of the ski-binding.

15. The locking mechanism of claim 14, wherein the one or more hook portions are provided in an alternating arrangement along the proximal end of the lever such that, when viewed along the pivoting axis of the lever, the hook portions form a C-shape or a circular shape, and wherein the one or more hook portions are adapted to be flexible such that the hook portions deform from the pivoting axis when engaging with the attachment portion.

16. The locking mechanism of claim 13, wherein the proximal end of the lever is integrally formed with either a mounting block adapted to be fixed to the ski-binding or the ski-binding itself, wherein the proximal end of the lever is adapted to have an increased flexibility compared to the lever and mounting block or ski-binding, thereby allowing pivoting movement of the lever at the proximal end.

17. The locking mechanism of claim 16, wherein the lever is provided with a decreased thickness at the proximal end thereof, the decreased thickness providing increased flexibility with respect to the lever.

18. The locking mechanism of claim 13, wherein the proximal end of the lever is provided with an axle holding portion adapted to receive an axle of the ski-binding, wherein the lever is pivoted via movement of the lever around the axle or via movement of the axle within the ski-binding.

19. The locking mechanism of claim 1, wherein the lug is adapted to be engaged with the notch in a water-tight manner when in the engaged position.

20. The locking mechanism of claim 1, wherein the lever is provided with an indent portion sized and shaped to receive at least a fingertip of an operator of the lever, thereby enabling the operator to grasp the lever when in the engaged position and actuate the lever to the disengaged position.

21. The locking mechanism of claim 1, wherein the lever is provided with a strap, the strap enabling an operator of the lever to grasp the strap when the lever is in the engaged position and actuate the lever to the disengaged position, wherein preferably, the strap is provided in a taut manner via one or more biasing wheels such that, when the strap is in a resting position, the strap is held against a top surface of the lever.

22. The locking mechanism of claim 1, wherein the lever comprises one or more side clips extending from a side surface of the lever, the side surface extending between a distal end and a proximal end of the lever, wherein the side clips are adapted to engage an edge portion of the ski-binding or the mounting plate.

23. A ski-binding adapted to receive only one locking mechanism of claim 1, wherein the ski-binding is adapted to be slidingly engaged with the mounting plate and, when the lug is engaged with the notch in the locked position, is adapted to be held in a non-sliding manner, wherein the ski-binding is not adapted to receive a second or more locking mechanism.

24. The ski-binding of claim 23, wherein the lever is integrally formed with the ski-binding and wherein the lever is biased to the disengaged position.

25. The ski-binding of claim 23, wherein, when the lever is in the disengaged portion, the ski-binding is adapted to slide in a forward and rearward direction with respect to the mounting plate.

26. The ski-binding of claim 23, wherein the ski-binding further comprises a lever-receiving hole adapted to receive the lever, and wherein the lever-receiving hole is adapted to pivotingly provide the lever at one end of the lever-receiving hole.

27. The ski-binding of claim 26, wherein the lever is provided as an integral part of the ski-binding, the lever provided at an end of the lever-receiving hole and adapted to pivot at the end.

28. The ski-binding of claim 26, wherein the ski-binding includes at least one of:

one or more recesses and/or one or more protrusions located at an end of the lever-receiving hole opposite to where the lever-receiving hole is adapted to pivotingly provide the lever, wherein the one or more recesses and one or more protrusions are adapted to receive corresponding recesses or protrusions located on the lever;

sliding plate accommodating means that is adapted to accommodate a part of a sliding plate when the lever is in the engaged position, or accommodate the entire sliding plate when the lever is in the disengaged position;

one or more side protrusions and one or more side recesses located at a side portion of the lever-receiving hole and adapted to receive side protrusions and side recesses of the lever; and an edge portion adapted to receive side clips provided on the lever.

29. The ski-binding of claim 26, wherein the lever-receiving hole is provided with an attachment region adapted to receive hook portions of the lever.

30. The ski-binding of claim 26, wherein the lever-receiving hole is provided with an axle, the axle adapted to be engaged with an axle holding portion of the lever.

31. The ski-binding of claim 23, wherein the ski-binding is provided with a user engagement recess for allowing a user to access an edge portion or an indent portion of the lever so as to enable actuation of the lever from the engaged position to the disengaged position.

32. A ski-binding comprising only one locking mechanism of claim 1, wherein the ski-binding is adapted to be slidingly engaged with the mounting plate and, when the lug is engaged with the notch in the locked position, is adapted to be held in a non-sliding manner, wherein the ski-binding does not comprise a second or more locking mechanism.

33. A mounting plate for use with the locking mechanism of claim 1, wherein the mounting plate comprises only one set of notches, wherein the set of notches comprises notches having the same shaped profile and orientated in the same direction.

34. A system including only one locking mechanism according to claim 1, wherein the ski-binding is adapted to slidingly engage with the mounting plate and the only one lever of the locking mechanism is adapted to engage with one of the one set of notches of the mounting plate, thereby preventing sliding movement of the ski-binding.

* * * * *